United States Patent [19]

Civita

[11] 3,940,133

[45] Feb. 24, 1976

[54] BALL RETRIEVING APPARATUS

[75] Inventor: Benny I. Civita, Forest Hills, N.Y.

[73] Assignee: Lawrence Peska Associates, Inc., New York, N.Y. ; a part interest

[22] Filed: July 29, 1974

[21] Appl. No.: 492,689

[52] U.S. Cl...... 273/58 C; 273/DIG. 20; 273/55 R

[51] Int. Cl.[2]..... A63B 43/02

[58] Field of Search..... 273/58 C, 189, 55, 65 R, 273/65 EC, 65 EE, 65 EG, DIG. 20

[56] References Cited

UNITED STATES PATENTS

| | | | |
|---|---|---|---|
| 667,563 | 2/1901 | Oakley | 273/58 C |
| 2,831,196 | 4/1958 | Schieber | 273/189 R |
| 3,324,851 | 6/1967 | Posner | 273/189 R X |
| 3,804,409 | 4/1974 | Schachner | 273/58 C X |

OTHER PUBLICATIONS

"The Sporting Goods Dealer", Oct. 1973, p. 41.

*Primary Examiner*—George J. Marlo

*Attorney, Agent, or Firm*—Richard E. Nanfeldt

[57] ABSTRACT

A ball retrieving apparatus used by a player for independently practicing the art of tossing a ball. The ball retrieving apparatus comprises a lightweight ball pivotally and detachably communicating with an elastic rubber band. The elastic rubber band is anchored to an adjustable wrist support band worn on the player's wrist. When the ball is tossed in a forward direction, the elastic rubber band is stretched in a forward direction. The ball snaps back to the player, when the rubber band has reached its maximum forward displacement.

7 Claims, 3 Drawing Figures

BALL RETRIEVING APPARATUS

SUMMARY OF THE INVENTION

My invention relates to an unique and novel concept permitting a forward tossed ball to be returned to the player tossing the ball.

It is known that ball members have been attached by means of an elastic band to stationary objects such as a rigid frame or a person's head. However, these aforementioned devices are ineffective as a ball retrieving apparatus because of the weight of the ball member as well as the support mechanism does not allow for maximum control over the tossed ball. The purpose of my invention is to provide a ball retrieving apparatus with maximum degree of efficiency of return of the ball to the player as well as improved control over the degree of accuracy in the tossing of the ball.

An advantage of my invention over the previously cited patents is that the weight characteristics of the ball permits maximum efficiency of return of the ball to the player. A further advantage of my invention is that the adjustable support wrist band provides improved control over the degree of accuracy in the tossing of the ball.

An elastic rubber band is pivotally mounted onto the surface of a ball. A common type of ball used in my invention is a standard shaped football, wherein the football is constructed of a lightweight thermoplastic foam having a plurality of apertures within the surface of the football. The second end of the elastic rubber band is looped onto a ring affixed to the top surface of an ajustable support wrist band.

BRIEF DESCRIPTION OF THE DRAWINGS

The objects and features of my invention may be understood with reference to the following detailed description of an illustrative embodiment of the invention, taken together with the accompanying drawings in which.

DESCRIPTION OF THE PREFERRED EMBODIMENT

Figure 1:
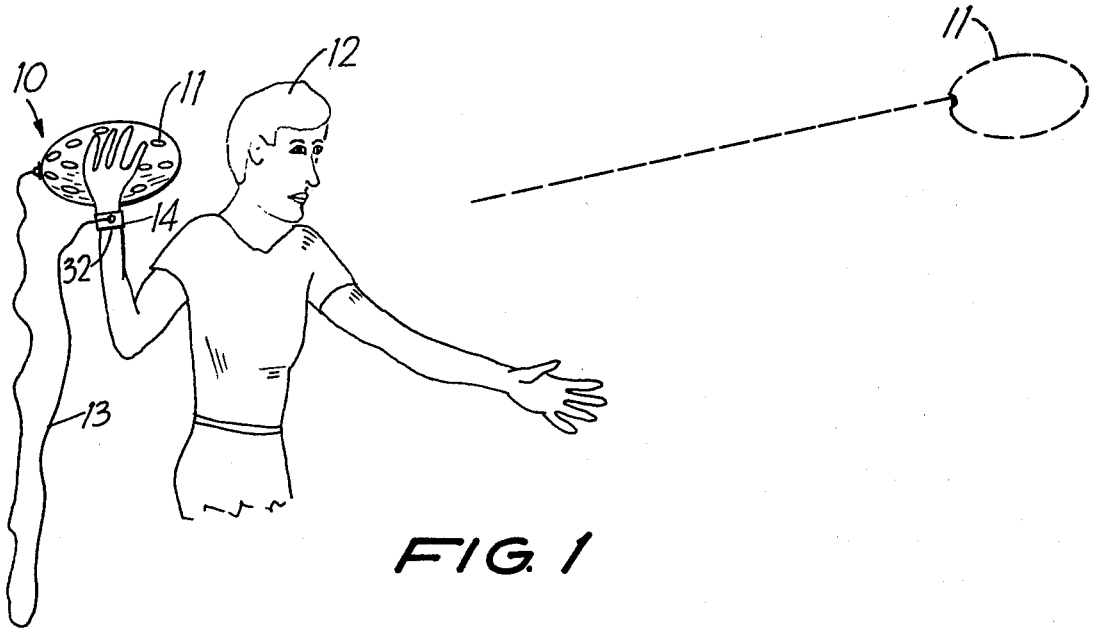
FIG. 1 illustrates a side elevated view of the ball retrieving apparatus in use.
Figure 2:
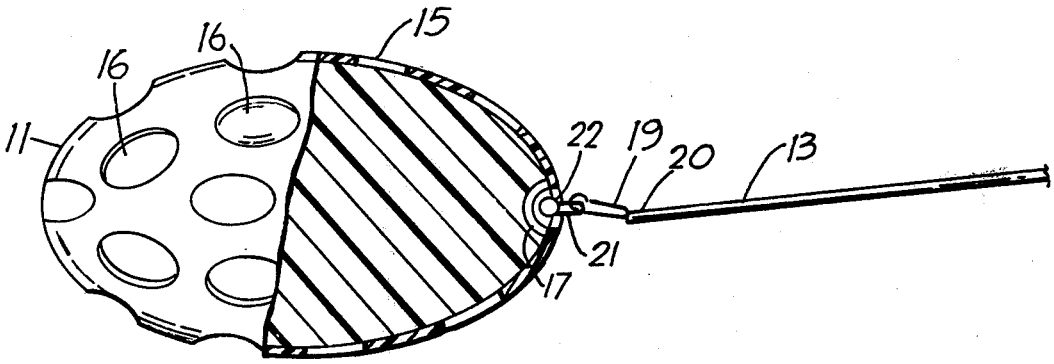
FIG. 2 illustrates a side view of the lightweight ball of the invention.
Figure 3:
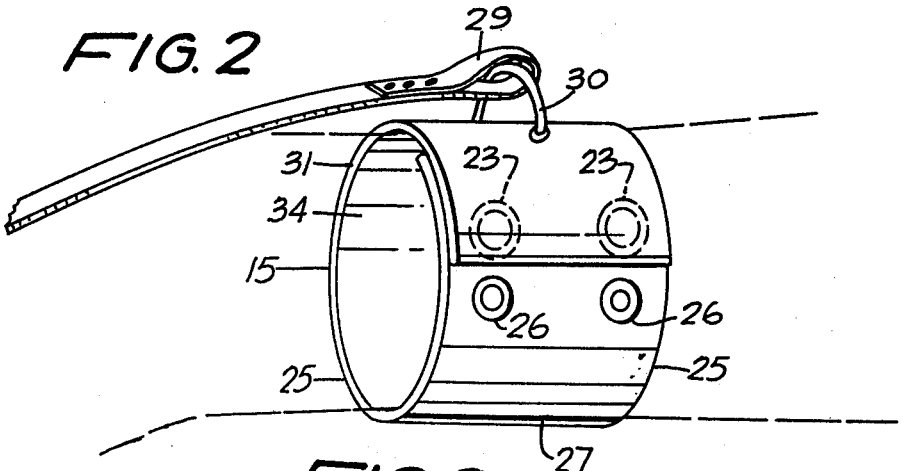
FIG. 3 illustrates a side perspective view of the adjustable wrist support band.

Turning now descriptively to the drawings, in which similar reference characters denote similar elements throughout the several views, FIG. 1 shows the ball retrieving apparatus 10, wherein a forward pass is being thrown by a player 12. When the football 11 has reached its maximum forward displacement, the football 11 snaps back to the player 12. The ball retrieving apparatus 10 comprises a lightweight football 11 communicating with an elastic rubber band 13 connected to an adjustable wrist support band 14. FIG. 2 shows the thermoplastic foamed football 11 formed in the shape of a standard football. The lightweight football 11 comprises a thermoplastic foamed member 15 having a plurality of apertures 16 on its outer surface 28. A socket member 17 is embedded in one end 18 of the football 11. A snaffle lock 19 is affixed to one end 20 of the elastic rubber band 13. A ring 21 is mounted onto a ball joint member 22. The ball joint member 22 is pivotally mounted into the socket member 17. The snaffle lock 19 clips onto the ring 21 of the ball joint member 22. FIG. 3 shows the attachment of the elastic rubber band 13 to the adjustable wrist support band 14. The adjustable wrist support band 14 comprises a flat flexible rectangular shaped member 31 with a plurality of snaps 23 embedded in the bottom surface 24 of the flat flexible rectangular shaped member 31. The snaps 23 are aligned along each longitudinal edge 25 of the flat flexible rectangular shaped member 31. A plurality of snap receiving members 26 are embedded in the top surface 27 of the flat flexible rectangular shaped member 31, wherein the snap receiving members 26 are aligned along each longitudinal edge 25. The snaps 23 and snap receiving members 26 are at opposite ends of the flat flexible rectangular shaped member 31 which wraps around the player's wrist 32. A U-shaped bracket 30 is mounted onto the top surface 27 of the flat flexible rectangular shaped member 31. The second end 29 of the elastic rubber 13 is looped around the U-shaped bracket 30 and joined back onto itself forming a loop attachment of the elastic rubber band 13 to the U-shaped bracket 30.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A ball retrieving apparatus used for a tossing of a ball in a forward direction, which comprises:

a. a thermoplastic foamed ball member;
b. an elastic rubber band;
c. an adjustable wrist support band;
d. a means for attaching said elastic rubber band to said adjustable wrist support band; and
e. a means for pivotally and detachably mounting said thermoplastic foamed ball member to said elastic rubber band.

2. A ball retrieving apparatus as recited in claim 1, wherein said adjustable wrist support band comprises:

a. a flat flexible rectangular shaped member having a top and a bottom surface, said flexible rectangular shaped member adapted to receive a wrist of a user;
b. a top surface of said flat flexible rectangular shaped member;
c. a bottom surface of said flat flexible rectangular shaped member;
d. (b) a plurality of snaps embedded in said bottom surface;
e. (c) a plurality of snap receiving members embedded in said top surface; and
f. (d) a U-shaped bracket affixed onto said top surface;
g. said flat flexible rectangular shaped member wrapped around a player's wrist with said snap inserted into said snap receiving members.

3. A ball retrieving apparatus as recited in claim 2, wherein said means of mounting said elastic rubber band to said adjustable wrist support band comprises:

a. a second end of said elastic rubber band looped through said U-shaped bracket; and
b. said second end of said elastic rubber band mounted back onto said elastic rubber band.

4. A ball retrieving apparatus as recited in claim 3, wherein said means for pivotally and detachably mounting said thermoplastic foamed ball member to said elastic rubber band comprises a. a socket member embedded in said thermoplastic ball member;
b. a ring;
c. said ring affixed onto a ball joint member;
d. said ball joint member pivotally mounted in said socket member;
e. a snaffle lock;
f. said snaffle lock affixed to a first end of said elastic rubber band; and
g. said snaffle lock clipped onto said ring.

5. A ball retrieving apparatus as recited in claim 4, wherein said thermoplastic foamed ball member comprises:

a. said thermoplastic foamed ball member having a plurality of apertures on its outer surface; and
b. said thermoplastic foamed ball member formed in a shape of a standard football.

6. A ball retrieving apparatus as recited in claim 5, wherein said elastic rubber band comprises a 12 foot length.

7. A football retrieving apparatus used for the tossing of a football in a forward direction, wherein said football automatically returns to a user, which comprises;

a. a thermoplastic foamed football having an outer surface and a pair of ends, said outer surface having a plurality of apertures therein;
b. a socket member embedded in one said end of said thermoplastic foamed football;
c. a ball joint member pivotally mounted in said socket member;
d. a ring affixed onto said ball joint member;
e. an elastic rubber band having a pair of ends;
f. a snaffle lock affixed onto a first said end of said elastic band, said snaffle lock engaging said ring;
g. an adjustable wrist support band adapted to receive a wrist of said user;
h. said wrist support band having a pair of ends, a bottom surface, and a top surface;
i. a plurality of snaps embedded in said bottom surface of said wrist support band at one said end thereof;
j. a plurality of snap receiving members embedded in said top surface of said wrist support band at said other end thereof; and
k. a U-shaped bracket affixed centrally onto said top surface of said wrist support band, said second end of said elastic band affixed onto said U-shaped bracket.

* * * * *